US005997203A

United States Patent [19]

Wang

[11] Patent Number: 5,997,203

[45] Date of Patent: Dec. 7, 1999

[54] WRITING INSTRUMENT

[75] Inventor: Thomas Wang, Taipei, Taiwan

[73] Assignee: Excel Rite Enterprise Co., Ltd., Taipei Hsien, Taiwan

[21] Appl. No.: 09/120,231

[22] Filed: Jul. 22, 1998

[30] Foreign Application Priority Data

Jun. 19, 1998 [TW] Taiwan ..... 87209809

[51] Int. Cl.[6] ..... B43K 21/22

[52] U.S. Cl. ..... 401/99; 401/115

[58] Field of Search ..... 401/99, 117, 115, 401/101

[56] References Cited

FOREIGN PATENT DOCUMENTS 86139 8/1957 Netherlands .
769740 4/1955 United Kingdom .

*Primary Examiner*—David J. Walczak
*Assistant Examiner*—Huyen Le
*Attorney, Agent, or Firm*—Dougherty & Troxell

[57] ABSTRACT

An improved writing instrument includes a main casing, a head portion, a relay rod, and a tail stopper. The head portion can be connected to the main casing and is centrally provided with a tip hole for passage of a reservoir tube. The tail stopper can be fitted to the relay rod. A core tube is disposed between the main casing opposite to a rear end of the head portion and the relay rod opposite to the tail stopper. The end of the core tube facing the head portion is provided with a core chamber, whereas the end facing the tail stopper is formed with a core tube hole. The section of the core tube facing the tail stopper has a smaller external diameter, with two or more ball holes symmetrically disposed therein. A core post is inserted in the core tube and has a post ring of a larger external diameter formed at a rear end thereof to serve as a limit. An intermediate portion of the core post is provided with a core groove corresponding to the positioning balls. A movable ring is slidably disposed between the relay rod and the core tube. When the head portion faces down, the core post and the movable ring slide downwardly, and the core post is restricted by the positioning balls and the movable ring. When the head portion faces up, the movable ring and the core post lower and retract.

5 Claims, 2 Drawing Sheets

WRITING INSTRUMENT

BACKGROUND OF THE INVENTION (a) Field of the Invention

The present invention relates to an improved writing instrument, and more particularly to an improved writing instrument in which the writing tip is retracted into the main casing and always faces up when the writing instrument is attached to the user's clothing so as to avoid staining the user's clothing.

(b) Description of the Prior Art

With the progress of material science and processing techniques, as well as the transition of society, the roles played by and the forms of writing instruments have become diversified and various. There are the traditional pencils, ballpoint pens, sign pens, etc. To a certain degree, writing instruments have a secondary function, for instance, symbolizing status, or appealing to users, or promoting commodities. But, nonetheless, writing is their basic and indispensable function.

As a matter of fact, in terms of the objects and manner of use of writing instruments, aside from the function of writing, how writing instruments are carried should also be given consideration since they are used almost anywhere. The most common way to carry a writing instrument is to provide a cap or clip so that the writing instrument may be attached to the user's pocket when not in use.

Actually, although the arrangement of a cap or clip on the writing instrument can in general achieve its basic effect, there is a major disadvantage. For writing instruments provided with a clip, the reservoir tube, i.e., the writing tip, is retracted by rotating. Since the writing tip faces down when the writing instrument is clipped to the user's pocket, if the writing tip is not completely retracted into the casing, it may project from the casing so that the ink stains the user's pocket. The consequence will be worse if it is a fountain pen or ballpoint pen and the ink can easily leak. Therefore, such kind of writing instrument provided with a clip and having a writing tip that faces down when not in use is not satisfactory.

SUMMARY OF THE INVENTION

The primary object of the present invention is to provide an improved writing instrument characterized in that the reservoir tube can be retracted into a head portion of the writing instrument with the writing tip always facing up when the writing instrument is attached to the user's clothing.

In order to achieve the above-mentioned object, the improved writing instrument according to the present invention comprises a main casing, a head portion, a relay rod, and a tail stopper. The head portion can be connected to the main casing and is centrally provided with a tip hole for passage of a reservoir tube. The tail stopper can be fitted to the relay rod. A core tube is disposed between the main casing opposite to a rear end of the head portion and the relay rod opposite to the tail stopper. The end of the core tube facing the head portion is provided with a core chamber, whereas the end facing the tail stopper is formed with a core tube hole. The section of the core tube facing the tail stopper has a smaller external diameter, with two or more ball holes symmetrically disposed therein. A core post is inserted in the core tube and has a post ring of a larger external diameter formed at a rear end thereof to serve as a limit. An intermediate portion of the core post is provided with a core groove corresponding to the positioning balls. A movable ring is slidably disposed between the relay rod and the core tube. When the head portion faces down, the core post and the movable ring slide downwardly, and the core post is restricted by the positioning balls and the movable ring. When the head portion faces up, the movable ring and the core post lower and retract.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

Basically, the writing instrument according to the present invention differs from the prior art in that the writing tip faces up and is retracted into the casing of the writing instrument that is attached to the user's pocket by means of a clip.

Figure 1:
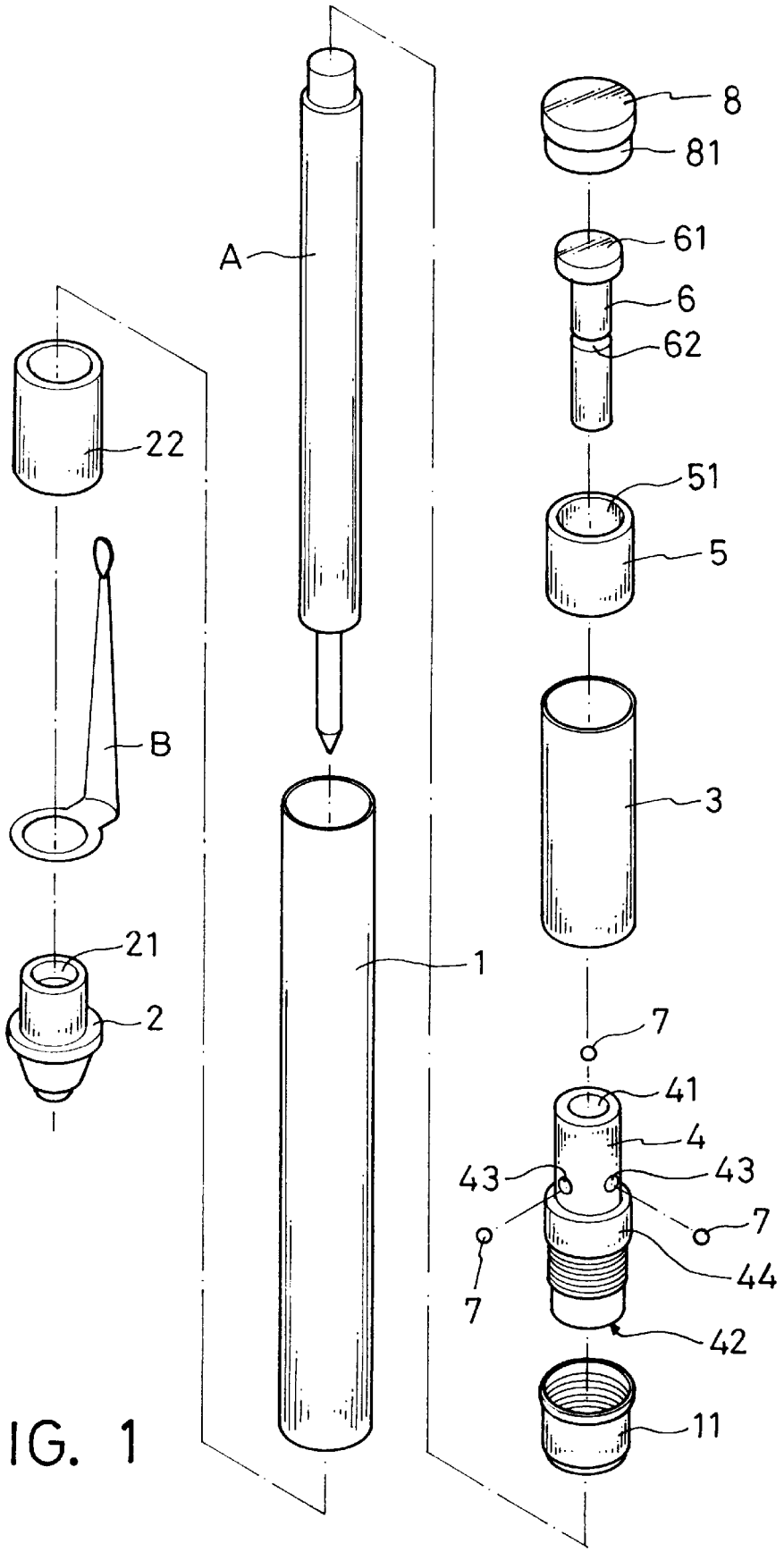
FIG. 1 is a perspective exploded view of the present invention.
Figure 2:
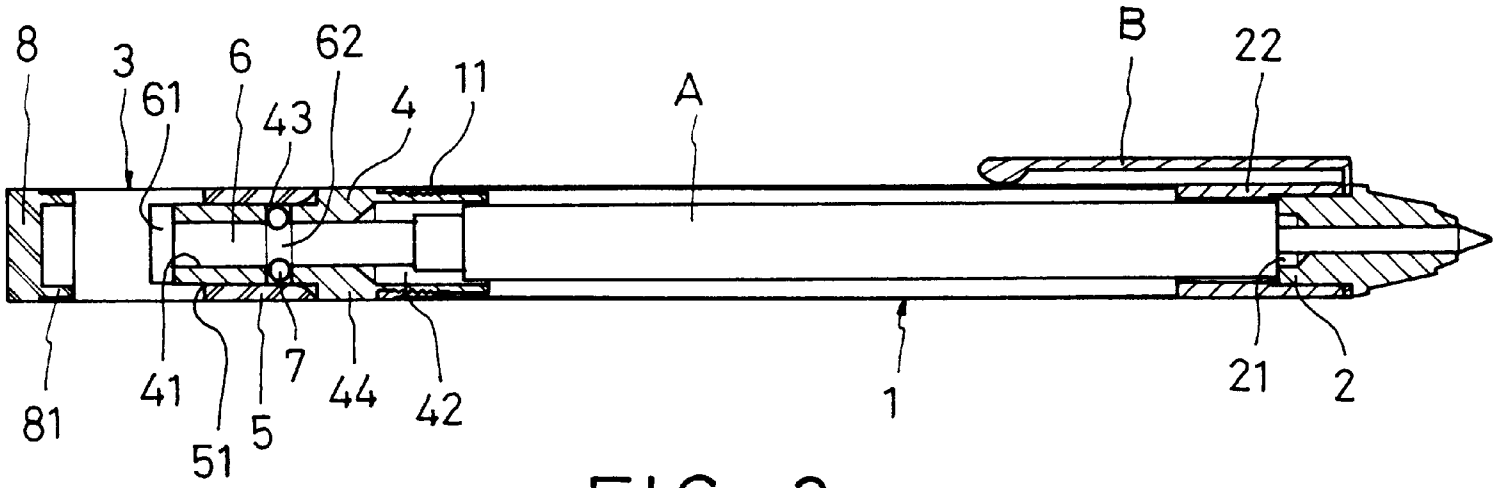
FIG. 2 is a sectional schematic view of the present invention in use.
Figure 3:
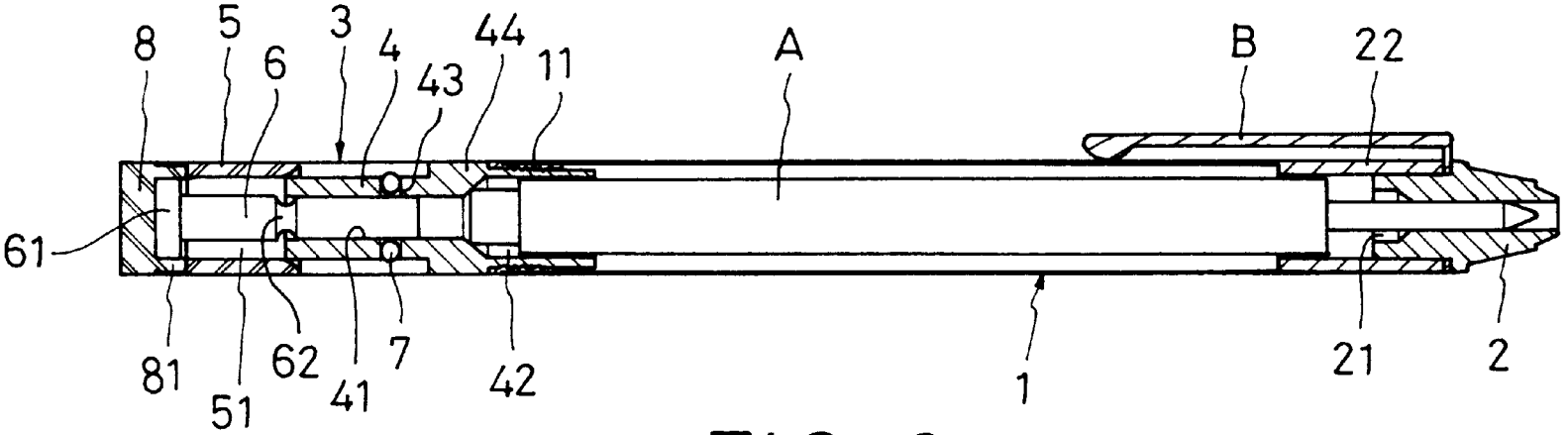
FIG. 3 is a schematic view showing the writing tip of the writing instrument according to the present invention in a retracted state.

As shown in FIGS. 1 to 3, the writing instrument according to the present invention comprises a main casing 1, a head portion 2, a relay rod 3, a core tube 4, a movable ring 5, a core post 6, a plurality of positioning balls 7, a tail stopper 8 and/or a reservoir tube A.

The main casing 1 is a hollow barrel preferably having a circular cross section. The function of the main casing 1 is to connect the head portion 2 and the relay rod 3. In order that it can be connected to the core tube 4, the main casing 1 is provided with a threaded casing sleeve 11 at an end opposite to the head portion 2. Alternatively, threads may be directly provided on an upper end of the main casing 1 for engagement purposes. However, the connection between the main casing 1 and the core tube 4 may also be insertably engaged in a tight fit manner.

The head portion 2 is a hollow tubular ring centrally provided with a tip hole 21 for passage of a reservoir tube. The external diameter of a rear central section thereof corresponds to that of the main casing 1 so that their diameters are equivalent. The external diameter of a rear section of the head portion 2 corresponds to the internal diameter of the main casing 1 for fitting purposes. In order that its engagement with the main casing 1 can be more secure, a packing ring 22 is added. However, the internal diameter of the packing ring 21 should be greater than that of the reservoir tube A.

The relay rod 3 is also a hollow rod structure having an external diameter preferably equivalent t that of the main casing 1. A rear end of the relay rod 3 can be connected to the tail stopper 8 by fitting or screwable engagement.

The core tube 4 is a tubular ring structure centrally having a core tube hole 41. The surrounding wall of a front end of the core tube 4 near the main rod 1 is thinned to form a funnel-shaped core chamber 42. A rear section of the core tube 4 has a smaller external diameter, and the periphery thereof is formed with at least two or more equi-angularly spaced ball holes 43 for receiving the positioning balls 7.

Besides, a core step 44 is defined between the front and rear sections of the core tube 4.

The movable ring 5 is a tubular ring structure including a movable ring hole 51 the internal diameter of which is larger than the external diameter of the core tube hole 41 of the core tube 4 yet smaller than the internal diameter of the relay rod 3, so that it can displace slidably therebetween.

The core post 6 has an external diameter smaller than that of the core tube hole 41 so that it can move slidably therein. A rear end thereof is provided with a post ring 61 to serve as a limit for its slidable movement. An intermediate section thereof is provided with a circumferentially recessed core groove 62 corresponding to the ball holes 43, the size and curvature thereof corresponding to the positioning balls 7 to be received therein.

The positioning balls 7 are preferably formed from metal. As mentioned hereinabove, the external diameter of each positioning ball 7 corresponds to the ball hole 43 and the core groove 62, and the positioning balls 7 correspond to the ball holes 43 in number.

The tail stopper 8 is a hollow structure sized to correspond to the relay rod 3 so that they may be fitted together or screwably connected. The internal diameter of a stopper wall 81 that orients in the direction of the head portion 2 corresponds to the post ring 61 so that the latter can be received therein during retraction.

Referring to the drawings, during assembly, the head portion 2 is insertably placed in the front end of the main casing 1, and the reservoir tube A (known) is received in the main casing 1. The core tube 4 is fitted to the other end of the main casing 1, and the core post 6 is placed in the core tube hole 41. Positioning balls 7 are also placed in the ball holes 43. Then, after fitting the movable ring 5 in position, the relay rod 3 is fitted, thus accomplishing the writing instrument as shown in FIGS. 2 and 3.

In actual use, referring to FIG. 2, when the head portion 2 faces down, the core post 6 will displace downwardly along the core tube hole 41 to urge against the reservoir tube A. At this point, the movable ring 5 will also displace downwardly to touch the core step 44 and fit over the positioning balls 7 and the core groove 62. Therefore, if the head portion 2 is subjected to force during writing, it will exert a force through the reservoir tube A to the core post 6. But since the core post 6 is restricted by the positioning balls 7, which in turn are pressed by the movable ring 5, the core post 6 cannot perform displacement. Hence, stable writing operation can be achieved.

When not in use, it is only necessary to have the head portion 2 facing up and slightly shake up-and-down, or tap the tail stopper 8 on the table, so that the movable ring 5 lowers to release the restriction posed by the positioning balls 7 on the core post 6 and cause the core post 6 to lower. As the reservoir core A is thereby not subjected to any force, a writing tip at the front end thereof is retracted into the head portion 2. In this way, the writing instrument can be carried with the head portion 2 facing up.

In order that the writing instrument of the present invention can be attached to the user's pocket for purposes of carrying, a clip B is provided between the head portion 2 and the main casing 1. As this is well known in the art, it will not be described in detail herein.

Therefore, by means of the present invention, the reservoir tube A can be retracted into the head portion 2 without being exposed on the outside when the writing instrument is being carried. As the writing tip of the reservoir tube A is always facing up, the ink will not leak out to stain the user's clothing. The problem with the prior art is therefore solved.

Although the present invention has been illustrated and described with reference to the preferred embodiment thereof, it should be understood that it is in no way limited to the details of such embodiment but is capable of numerous modifications within the scope of the appended claims.

What is claimed is:

1. An improved writing instrument, comprising:

a main casing that is a hollow rod structure;

a head portion that can be connected to said main casing and that is centrally provided with a tip hole for passage of a reservoir tube;

a relay rod that is a tubular structure; and a tail stopper that can be fitted to said relay rod; wherein a core tube is disposed between said main casing opposite to a rear end of said head portion and said relay rod opposite to said tail stopper, that end of said core tube facing said head portion being provided with a core chamber and that end facing said tail stopper being formed with a core tube hole, that section of said core tube facing said tail stopper having a smaller external diameter, with two or more ball holes symmetrically disposed therein, a core post being inserted in said core tube and having a post ring of a larger external diameter formed at a rear end thereof serving as a limit, an intermediate portion of said core post being provided with a core groove corresponding to said positioning balls, a movable ring being slidably disposed between said relay rod and said core tube, whereby when head portion faces down, said core post and said movable ring slide downwardly, said core post being restricted by said positioning balls and said movable ring, and whereby when said head portion faces up, said movable ring and said core post lower and retract.

2. The improved writing instrument as defined in claim 1, wherein the action of said core post and said core tube is of a contact type or a non-contact type.

3. The improved writing instrument as defined in claim 1, wherein a clip is disposed between said main casing and said head portion.

4. The improved writing instrument as defined in claim 1, wherein said relay rod and said tail stopper may be integrally formed.

5. The improved writing instrument as defined in claim 1, wherein said positioning balls, said core post, and said movable ring are preferably formed from metal.

* * * * *